US007925188B2

(12) United States Patent
Senoh et al.

(10) Patent No.: US 7,925,188 B2
(45) Date of Patent: Apr. 12, 2011

(54) DEVELOPMENT DEVICE, PROCESS CARTRIDGE, AND IMAGE FORMING APPARATUS USING THE DEVELOPMENT DEVICE

(75) Inventors: Tetsuya Senoh, Machida (JP); Eisaku Murakami, Tokyo (JP); Masahiko Satoh, Kawanishi (JP); Masanori Kawasumi, Yokohama (JP); Hideki Zemba, Kawasaki (JP); Takeshi Uchitani, Kamakura (JP); Kenichi Taguma, Yokohama (JP); Shunichi Hashimoto, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 464 days.

(21) Appl. No.: 12/049,838

(22) Filed: Mar. 17, 2008

(65) Prior Publication Data

US 2008/0226311 A1 Sep. 18, 2008

(30) Foreign Application Priority Data

Mar. 15, 2007 (JP) ..... 2007-067292
Mar. 3, 2008 (JP) ..... 2008-052525

(51) Int. Cl.
*G03G 15/08* (2006.01)

(52) U.S. Cl. ..... 399/255; 399/61; 399/258

(58) Field of Classification Search ..... 399/222, 399/255, 258
See application file for complete search history.

(56) References Cited

U.S. PATENT DOCUMENTS 6,345,163 B1 * 2/2002 Suzuki et al. ..... 399/61
7,292,817 B2 11/2007 Murakami et al.
7,313,353 B2 12/2007 Satoh et al.
2007/0036595 A1 2/2007 Amemiya et al.
2007/0059071 A1 3/2007 Shinshi et al.
2007/0065178 A1 3/2007 Shimojo et al.
2007/0091657 A1 4/2007 Uchitani
2007/0110464 A1 5/2007 Nakayama et al.
2007/0122202 A1 5/2007 Taguma et al.
2007/0122217 A1 5/2007 Nagashima et al.
2007/0127951 A1 6/2007 Ishikawa et al.
2007/0154246 A1 7/2007 Shintani et al.
2007/0166074 A1 7/2007 Hosokawa et al.
2007/0177905 A1 8/2007 Hosokawa et al.
2007/0183824 A1 8/2007 Suda et al.
2007/0196123 A1 8/2007 Mizuishi et al.

(Continued)

FOREIGN PATENT DOCUMENTS

JP 2004-69789 3/2004
JP 2006-259166 9/2006

*Primary Examiner* — David M Gray
*Assistant Examiner* — Roy Yi
(74) *Attorney, Agent, or Firm* — Oblon, Spivak, McClelland, Maier & Neustadt, L.L.P.

(57) ABSTRACT

A novel development device includes a developer roller, a developer reservoir, a rotatable conveyor, and a replenisher unit. The developer roller is configured to supply toner particles to the electrostatic latent image. The developer reservoir is configured to hold the developer therewithin for application to the developer roller. The rotatable conveyor is configured to rotate within the developer reservoir to convey the developer toward the developer roller. The replenisher unit has a tubular member terminating at a port opening in the developer reservoir. The replenisher unit is configured to direct a particulate material through the tubular member into the developer reservoir via the port. The particulate material is toner particles, carrier particles, or a mixture of toner particles and a given amount of carrier particles. The port is submerged in the developer within the developer reservoir as the rotatable conveyor rotates.

14 Claims, 7 Drawing Sheets

U.S. PATENT DOCUMENTS

2007/0212121 A1 9/2007 Takahashi et al.
2007/0242985 A1 10/2007 Aoki et al.
2007/0280740 A1 12/2007 Senoh
2007/0286628 A1 12/2007 Kayahara et al.
2008/0008499 A1 1/2008 Satoh et al.
2008/0253804 A1* 10/2008 Furuta et al. ..... 399/119

* cited by examiner

DEVELOPMENT DEVICE, PROCESS CARTRIDGE, AND IMAGE FORMING APPARATUS USING THE DEVELOPMENT DEVICE

CROSS-REFERENCE TO RELATED APPLICATIONS

The present patent application claims priority under 35 U.S.C. §119 from Japanese Patent Application Nos. 2007-067292 and 2008-052525, filed on Mar. 15, 2007 and Mar. 3, 2008, respectively, the entire contents of each of which are hereby incorporated by reference herein in their entirety.

BACKGROUND OF THE INVENTION

1. Field of the Invention

The present invention relates to a development device, a process cartridge, and an image forming apparatus using the development device, and more particularly, to a development device with enhanced mixing performance which can effectively supply particulate material for mixing into electrophotographic developer, and a process cartridge and image forming apparatus incorporating such a development device.

2. Discussion of the Background

Electrophotographic image forming apparatuses, such as printers, photocopiers, and facsimiles, typically implement a development system for developing an electrostatic latent image formed on a photosensitive surface into a visible image. In electrophotographic image formation, development is performed using a developer material which is typically a mixture of toner and carrier particles. A development device or a process cartridge incorporating a developing feature includes a developer reservoir that provides a developer mixture to a developer roller for applying toner to the photosensitive surface.

In a common configuration, the developer reservoir has a mixing chamber in which an agitating member such as a screw conveyor agitates and conveys the developer mixture toward the developer roller. As the developer becomes depleted of toner through use, the developer reservoir receives new toner at a toner inlet located on an upper side of the mixing chamber. The toner supply is dispensed to fall onto the surface of contents of the mixing chamber.

Such a configuration is less reliable in mixing developer sufficiently and uniformly, however. As toner typically has a low relative density with respect to developer containing magnetic carrier particles, toner particles supplied from above tend to glide or flow over the surface of the existing developer particles. Insufficient mixing degrades homogeneity in toner concentration and causes various defects due to poorly charged toner particles, such as toner scattering on prints and/or toner contamination inside the machine. In particular, when the gliding toner reaches a portion adjacent to the developer roller in the mixing chamber, the poorly charged particles may result in non-uniform areas present on corresponding parts of developed images. Such a problem becomes serious when the development device features compact size and enhanced operating speed, which typically involves difficult conditions for developer mixing, for example, increasing the amount of toner dispensed at a time, or reducing the size of the agitating member used in the mixing chamber. Not surprisingly, various methods have been proposed to improve mixing performance of development devices.

Referring to FIGS. 1A and 1B, cross-sectional side views schematically illustrating an example of a conventional development device 109 in different states are described.

As shown in FIG. 1A, the development device 109 includes a developer reservoir 114 defining first and second chambers 114*a* and 114*b* each supporting first and second screw conveyors 101 and 102, a developer roller 107, a toner inlet 119, and a toner guide 112. The first and second chambers 114*a* and 114*b* hold developer 113 including toner particles and carrier particles.

In the development device 109, a supply of toner is dispensed to the toner inlet 119 disposed on an upper side of the developer reservoir 114. The toner inlet 119 leads to a vertical guide path defined by the toner guide 112 at one side of the first chamber 114*a*. The supplied toner travels along the guide path to enter the first chamber 114*a* as the first screw conveyor 101 rotates in a direction of arrow X0.

The development device 109 is designed to effectively introduce the supply of toner into the developer 113, wherein the toner guide 112 is assumed to penetrate below a top surface of the contents of the first chamber 114*a*. However, such a method may be invalid or not reliable considering that the level or the position of the surface of the contents of the first chamber 114*a* changes as the development device 109 operates to transport and consume the developer 113 therewithin.

Thus, as shown in FIG. 1B, during operation, the rotation of the first screw conveyor 101 may move the contents of the first chamber 114*a* to a side away from the guide path, so that the top surface of the contents slopes down toward the lower end of the toner guide 112. As a result, the toner exiting the guide path falls down onto a lower portion of the sloping surface and glides thereover without mixing into the developer 113 therebeneath. The developer 113 insufficiently mixed may not offer acceptable performance in developing electrophotographic images.

Accordingly, there is a need for a development device with enhanced mixing performance which can effectively and reliably supply particulate material for mixing into electrophotographic developer. An electrophotographic system incorporating such an apparatus may produce high quality images with desirable uniformity while reducing defects due to poorly charged toner particles.

SUMMARY OF THE INVENTION

Exemplary aspects of the present invention are put forward in view of the above-described circumstances, and provide a novel development device to develop an electrostatic latent image formed on a photoconductive surface with a developer formed of toner and carrier.

Other exemplary aspects of the present invention provide a novel integrated process cartridge that is removably installable in an image forming apparatus.

Still other exemplary aspects of the present invention provide a novel image forming apparatus.

In one exemplary embodiment, the novel development device includes a developer roller, a developer reservoir, a rotatable conveyor, and a replenisher unit. The developer roller is configured to supply toner particles to the electrostatic latent image. The developer reservoir is configured to hold the developer therewithin for application to the developer roller. The rotatable conveyor is configured to rotate within the developer reservoir to convey the developer toward the developer roller. The replenisher unit has a tubular member terminating at a port opening in the developer reservoir, and is configured to direct particulate material through the tubular member to the developer reservoir via the port. The particulate material is toner particles, carrier particles, or a mixture of toner particles and a given amount of carrier particles. The port is submerged in the developer within the developer reservoir as the rotatable conveyor rotates.

In one exemplary embodiment, the integrated process cartridge includes a photoconductor and the development device described above. The photoconductor is configured to form an electrostatic latent image thereon.

In one exemplary embodiment, the image forming apparatus includes the photoconductor and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1A:
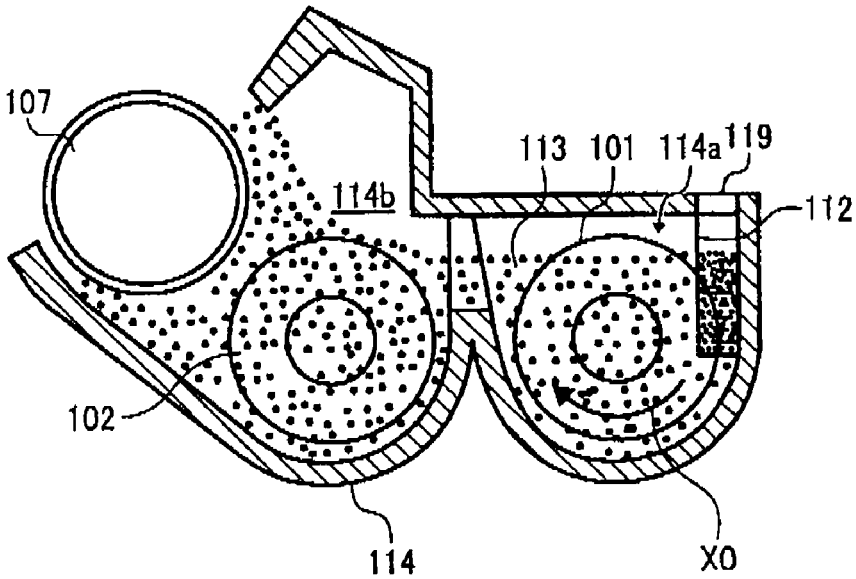
FIG.1A BACKGROUND ART
FIGS. 1A and 1B are cross-sectional side views schematically illustrating an example of a conventional development device in different states.
Figure 1B:
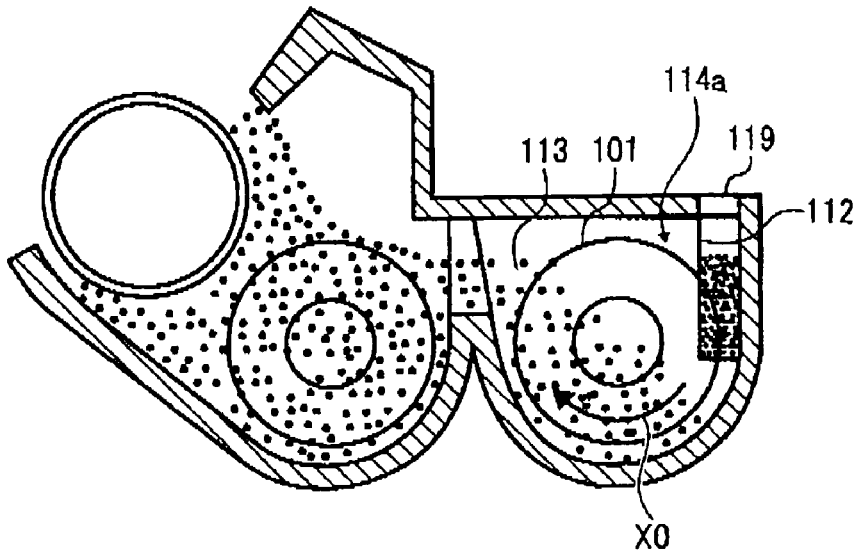
FIG.1B BACKGROUND ART

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
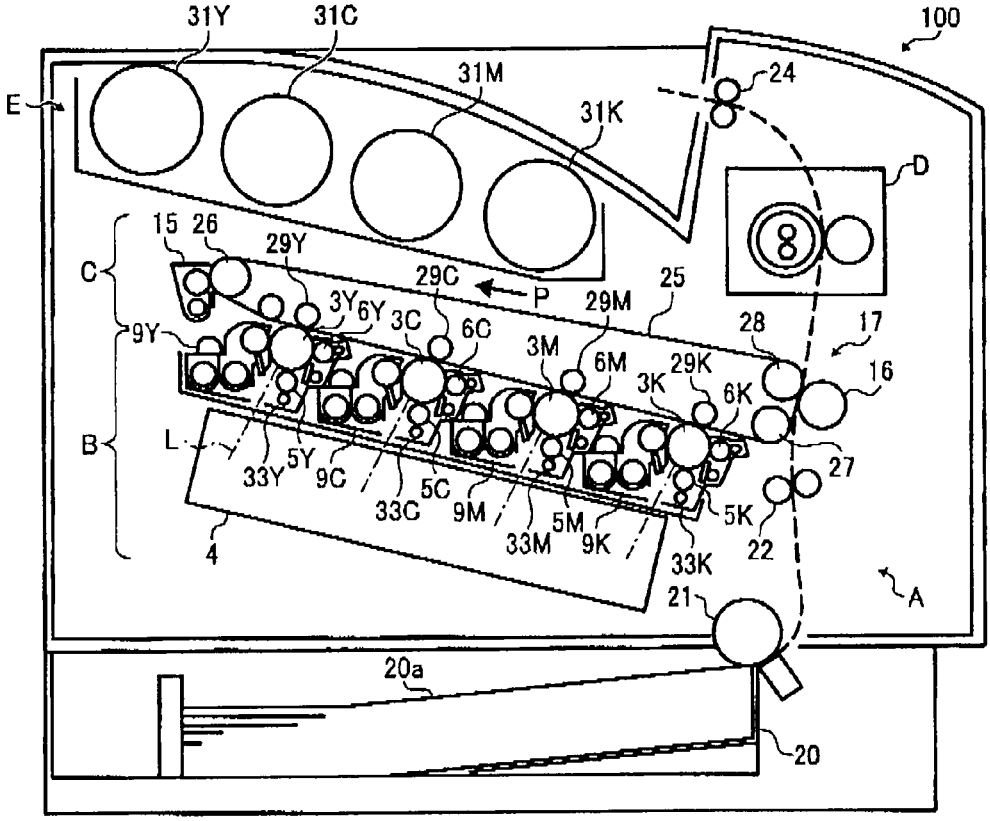
FIG. 2 illustrates an image forming apparatus according to at least one exemplary embodiment.

Referring to FIG. 2 of the drawings, an image forming apparatus 100 according to at least one exemplary embodiment is described.

As shown in FIG. 2, the image forming apparatus 100 includes a sheet feed unit A, an electrophotographic unit B, a transfer unit C, a fixing unit D, and a toner supply E.

In the image forming apparatus 100, the sheet feed unit A includes a sheet cassette 20 containing a recording sheet 20*a*, a pick-up roller 21, a pair of registration rollers 22, and a pair of output rollers 24. The sheet feed unit A forms a sheet path along which the recording sheet 20*a* advances upward past the transfer unit C and the fixing unit D to an output tray.

The electrophotographic unit B is located adjacent to the sheet feed unit A. The electrophotographic unit B includes four image forming units 33Y, 33C, 33M, and 33K, and a scanning unit 4. Each of the image forming units 33Y, 33C, 33M, and 33K has a separate drum-shaped photoconductor 3Y, 3C, 3M, and 3K, a charging device 5Y, 5C, 5M, and 5K, a cleaning device 6Y, 6C, 6M, and 6K, and a development device 9Y, 9C, 9M, and 9K. The scanning unit 4 emits a laser beam L to each of the image forming units 30Y, 30C, 30M, and 30K, respectively.

The transfer unit C is located beside the sheet feed unit A in close proximity to the electrophotographic unit B. The transfer unit C includes a flexible, endless intermediate transfer belt 25, rollers 26 through 28, primary transfer rollers 29Y, 29C, 29M, and 29K, a secondary transfer roller 16, and a belt cleaner 15. The intermediate transfer belt 25 is stretched about the rollers 26 through 28 as well as the primary transfer rollers 29Y, 29C, 29M, and 29K, and rotates therearound in a direction of arrow P. The primary transfer rollers 29Y, 29C, 29M, and 29K are opposed to the photoconductors 3Y, 3C, 3M, and 3K to define primary transfer nips through which the intermediate transfer belt 25 passes with an outer surface thereof substantially contacting the photoconductors 3Y, 3C, 3M, and 3K. The secondary transfer roller 16 and the roller 28 are opposed to define a secondary transfer nip 17 through which the intermediate transfer belt 25 travels with the outer surface substantially contacting the secondary transfer roller 16. The belt cleaner 15 is located opposite the roller 26 for cleaning the outer surface of the intermediate transfer belt 25.

The fixing unit D is located along the sheet feed unit A adjacent to the transfer unit C. The fixing unit D includes appropriate heating means and conveying means.

The toner supply E is located above the electrophotographic unit B and the transfer unit C. The toner supply E includes toner bottles 31Y, 31C, 31M, and 31K. Each toner bottle stores toner of a particular color, and provides a toner supply to the electrophotographic unit B through an appropriate delivery means such as a tube. Each toner bottle may be released from a housing, not shown, to be refilled with toner or replaced with a new one as needed.

In the above description, suffix letters "Y", "C", "M", and "K" assigned to reference numerals denote toner colors used in the image forming apparatus 100, where "Y" denotes yellow, "C" for cyan, "M" for magenta, and "K" for black. Each of these suffix letters is used to refer to components having functions associated with a particular toner color and/or formation of a sub-image of such toner color. Consequently, components marked with the same suffix will be regarded as elements associated with each other, while components marked with the same numeric character will be regarded as equivalent and/or corresponding elements. In the following portions of this patent specification, these suffixes will be omitted for ease of illustration and explanation except where necessary to identify a particular element among the equivalent and/or corresponding components.

During operation, in the sheet feed unit A, the pick-up roller 21 removes the recording sheet 20*a* from the sheet cassette 20 to the pair of registration rollers 22. The pair of registration rollers 22 moves the recording sheet 20*a* in registration, so that the recording sheet 20*a* enters the transfer nip 17 at a given time for image transfer.

In the electrophotographic unit B, the charging device 5 uniformly charges a surface of the photoconductor 3 at each image forming unit 33. The photoconductor 3 is exposed to the laser beam L from the scanning unit 4 and forms an electrostatic latent image thereon. The development device 9 applies toner of a particular color to the electrostatic latent image to form a toner image on the photoconductor 3. The image forming units 30Y, 30C, 30M, and 30K perform such process to form yellow, cyan, magenta, and black sub-images on the photoconductors 3Y, 3C, 3M, and 3K, respectively.

In the transfer unit C, the intermediate transfer belt 25 rotates to pass a given portion thereof through the primary transfer nips in a timed sequence. At the same time, a transfer voltage is applied to each of the primary transfer rollers 29Y, 29C, 29M, and 29K so as to sequentially transfer the sub-images from the photoconductor 3Y, 3C, 3M, and 3K to the given portion of the rotating intermediate transfer belt 25. Thus, the different toner images are superimposed one atop another to form a multicolor toner image. The formed image is then forwarded to the transfer nip 17, and transferred to the recording sheet 20*a* from the intermediate transfer belt 25.

Thereafter, the recording sheet 20*a* advances along the sheet path to enter the fixing unit D. The fixing unit D applies heat to the recording sheet 20*a* to stabilize the toner image thereon. After the formed image is thus fixed in place, the pair of output rollers 24 conveys the recording sheet 20*a* to an output tray.

Preferably, the image forming apparatus 100 performs such electrophotographic process with a two-component developer including toner particles and carrier particles. Although the embodiment as illustrated in FIG. 2 uses a tandem color printer architecture, the image forming apparatus 100 may be configured as any electrophotographic system adapted to produce images either in color or in black and white.

Figure 3:
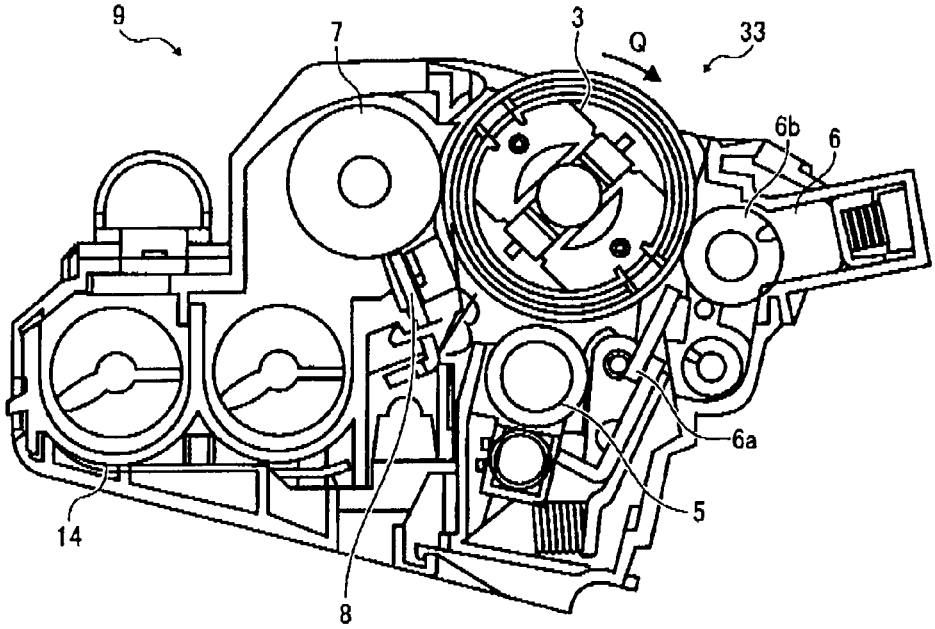
FIG. 3 is a schematic diagram illustrating an example of an image forming unit, incorporated in the image forming apparatus of FIG. 2.

Referring now to FIG. 3, a schematic diagram illustrating an example of the image forming unit 33 is described which may be incorporated in the image forming apparatus 100.

As shown in FIG. 3, the image forming unit 33 has the photoconductor 3 surrounded by the cleaning device 6, the charging device 5, and the development device 9. The cleaning device 6 includes a cleaner 6*a* and a lubricant applicator 6*b*, or alternatively, may be configured without the lubricant applicator 6*b*. The development device 9 includes a developer roller 7, a doctor blade 8, and a developer reservoir 14.

In the image forming unit 33, the photoconductor 3 is rotatable in a direction of arrow Q to move an outer surface thereof past the surrounding components. The cleaning device 6 serves to remove residual toner particles from the photoconductor 3 after a primary transfer process. The charging device 5 serves to uniformly charge the photoconductor 3 for scanning process. The development device 9 stores developer material including toner, not shown, in the developer reservoir 14, and serves to deliver the toner to the photoconductor 3 by the developer roller 7 and the doctor blade 8 following the scanning process.

Although not limited thereto, it may be preferable that the cleaning device 6, the charging device 5, and the development device 9 be integrated into a single unit with the photoconductor 3, and that all the components of the image forming unit 33 be enclosed within a single removable cartridge. When used within an electrophotographic system such as in the electrophotographic unit B of the image forming apparatus 100, such an integrated configuration facilitates installation and access for service and maintenance of the image forming unit 33.

Figure 4A:
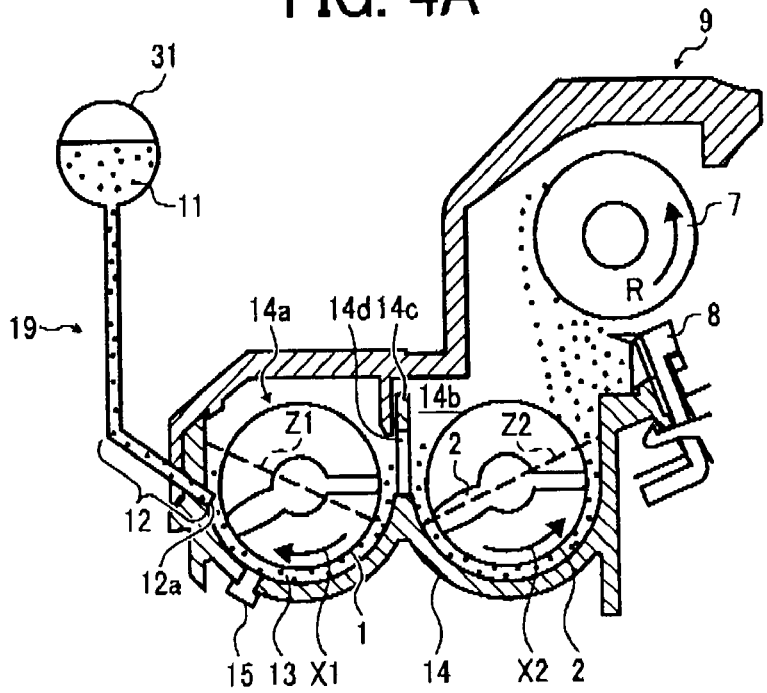
FIGS. 4A and 4B are cross-sectional side and top views schematically illustrating an example of a development device, incorporated in the image forming unit of FIG. 3.
Figure 4B:
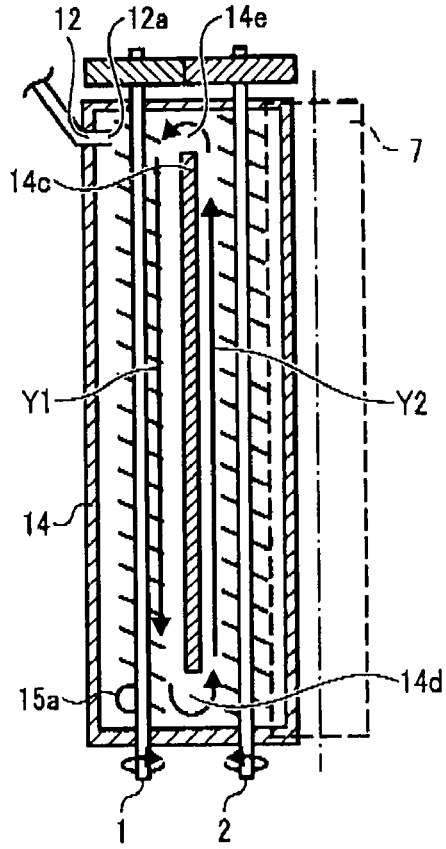

Referring now to FIGS. 4A and 4B, cross-sectional side and top views schematically illustrating an example of the development device 9 are described which may be incorporated in the image forming unit 33.

As shown in FIGS. 4A and 4B, the development device 9 includes a replenisher unit 19 in addition to the developer roller 7, the doctor blade 8, and the developer reservoir 14. The development device 9 uses a two-component developer 13 including toner particles with a diameter of approximately 10 μm or less, and magnetic carrier particles with a diameter ranging from approximately 20 to approximately 100 μm. The toner bottle 31 stores toner 11 of a particular color.

In the development device 9, the replenisher unit 19 connects the toner bottle 31 and the developer reservoir 14. The replenisher unit 19 forms a tubular portion including a replenisher tube 12 extending downward from an upper part of the replenisher unit 19. The replenisher tube 12 is obliquely inserted into the developer reservoir 14, and terminates at an open port 12*a* opening into the first chamber 14*a*.

The developer reservoir 14 is located below the toner bottle 31. The developer reservoir 14 defines elongated first and second chambers 14*a* and 14*b*, in which the developer 13 is held for application to the developer roller 7. The first and second chambers 14*a* and 14*b* are separated by a separating wall 14*c* disposed therebetween, and communicate with each other through first and second apertures 14*d* and 14*e* disposed at both ends of the separating wall 14*c*. The first chamber 14*a* communicates with the replenisher unit 19 via the open port 12*a* at a location adjacent to the second aperture 14*e*. The second chamber 14*b* is open to communicate with the developer roller 7 disposed thereabove.

The first and second chambers 14*a* and 14*b* each supports a first screw conveyor 1 and a second screw conveyor 2, respectively. The first screw conveyor 1 has an elongated shaft with a helical flight rotatable about a longitudinal axis within the first chamber 14*a*. Similarly, the second screw conveyor 2 has an elongated shaft with a helical flight rotatable about a longitudinal axis within the first chamber 14*b*. The first screw conveyor 1 has an outer perimeter facing the open port 12*a* of the replenisher tube 12. Further, the first chamber 14*a* includes a toner concentration sensor 15. The toner concentration sensor 15 is located below the first screw conveyor 1 adjacent to the first aperture 14*d*, and has a receptor surface 15*a* substantially perpendicular to a radius of the first screw conveyor 1.

In addition, the developer roller 7 and the doctor blade 8 are disposed above the developer reservoir 14. The developer roller 7 has a rotatable cylindrical sleeve, not shown, and a stationary magnet positioned at a center thereof, not shown, which establishes a magnetic field of a given strength and shape therearound. The cylindrical sleeve is motor-driven to rotate about a center axis thereof. The doctor blade 8 is located in close proximity to the cylindrical sleeve of the developer roller 7.

During operation, the developer roller 7 magnetically attracts the developer 13 from the developer reservoir 14 while the cylindrical sleeve rotates in a direction of arrow R. The developer 13 forms a layer on the rotating cylindrical sleeve where carrier particles build up to form brush-like bristles with toner particles adhering to surfaces thereof. The doctor blade 8 contacts the developer layer to adjust the amount of particles on the developer roller 7. The developer roller 7 brings the developer layer into close proximity to a photoconductive surface, not shown, where toner particles on the carrier particles are electrostatically attracted to an electrographic latent image formed on the photoconductive surface. After the latent image is thus converted to a visible toner image, the developer roller 7 releases remaining developer particles into the developer reservoir 14 by removing the magnetic force.

The replenisher unit 19 supplies the toner 11 from the toner bottle 31, which is dispensed by a given dispensing means, not shown, controlled by a central processing unit (CPU), not shown. When dispensed, the toner 11 travels downward along the replenisher tube 12 to reach the developer reservoir 14 aided only by gravitational force.

In the developer reservoir 14, the developer 13 circulates between the first and second chambers 14*a* and 14*b*. Within the first chamber 14*a*, the developer 13 travels in a direction of arrow Y1 as the first screw conveyor 1 rotates in a direction of arrow X1. Similarly, within the second chamber 14*b*, the developer 13 travels in a direction of arrow Y2 as the second screw conveyor 2 rotates in a direction of arrow X2.

The first chamber 14*a* receives the toner 11 from the replenisher unit 19 via the open port 12*a* at one extremity thereof (i.e., adjacent to the second aperture 14*e*), where the developer 13 relatively low in toner concentration flows from the second chamber 14*b* to merge with the supplied toner 11. Upon rotation of the first screw conveyor 1, the developer 13 is agitated and mixed while propelled to move toward another extremity of the first chamber 14*a* (i.e., adjacent to the first aperture 14*d*). At the same time, the toner concentration sensor 15 detects toner concentration of the developer 13 and transmits a voltage signal to the CPU according to the detected information. Based on the transmitted voltage signal, the CPU determines whether or not the developer 13 has a toner concentration above a given threshold, and causes the dispensing means to dispense the toner 11 from the toner bottle 31 as long as the detected concentration does not exceed the given threshold and to stop dispensing when the detected concentration exceeds the given threshold.

The second chamber 14*b* delivers the developer 13 to an area below the developer roller 7 for development. After the application of toner, the second chamber 14*b* receives developer particles removed from the developer roller 7 for recirculation in the developer reservoir 14. At one extremity of the second chamber 14*b* (i.e., adjacent to the first aperture 14*d*), the developer 13 relatively high in toner concentration flows from the first chamber 14*b*. Upon rotation of the second screw conveyor 2, the developer 13 is agitated and mixed while propelled to another extremity of the second chamber 14*b* (i.e., adjacent to the second aperture 14*e*).

In such a configuration, the developer 13 tends to drift toward one side of the first chamber 14*a* in response to an upward motion of the rotating first screw conveyor 1. This leads to unevenness in the level of the contents in the first chamber 14*a*, forming an inclined surface Z1 sloping downwardly from one side to another (left side higher than right in FIG. 4A). Similarly, an upward motion of the rotating second screw conveyor 2 results in unevenness in the level of the contents in the second chamber 14*b*, forming an inclined surface Z2 sloping downwardly from one side to another (right side higher than left in FIG. 4A). In the development device 9, the location of components is determined with consideration given to such uneven distribution or inclined surfaces of the contents of the developer reservoir 14.

As shown in FIG. 4A, the open port 12*a* of the replenisher tube 12 is located on the left side of the first chamber 14*a* at a position lower than the inclined surface Z1. In specifying the vertical position of the open port 12*a*, the development device 9 is driven with a specified quantity of developer, which is defined by a minimum tolerance to be initially loaded in the developer reservoir 14, and of which the toner concentration is adjusted to a specified minimum limit or even zero. The open port 12*a* is located below a height at which the inclined surface Z1 is positioned on the left side with the lowest possible quantity of developer, representing the level on the left side above which the contents of the first chamber 14*a* are reliably present during operation of the development device 9. The specified vertical position may keep the open port 12*a* submerged in the developer 13 as long as the development device 9 operates properly.

Further, as shown in FIG. 4B, the toner concentration sensor 15 is slightly offset to the left side of the first chamber 14*a* at which the height of the developer 13 is greater than at the opposite side of the first chamber 14*a*.

According to the embodiment depicted in FIGS. 4A and 4B, a supply of toner may be introduced into the developer 13 without gliding over the surface of contents of the mixing chambers 14*a* and 14*b*. This provides desirable mixing of developer material in electrophotographic development, enhancing density uniformity of developed images and reducing defects due to insufficiently charged toner particles.

Figure 5A:
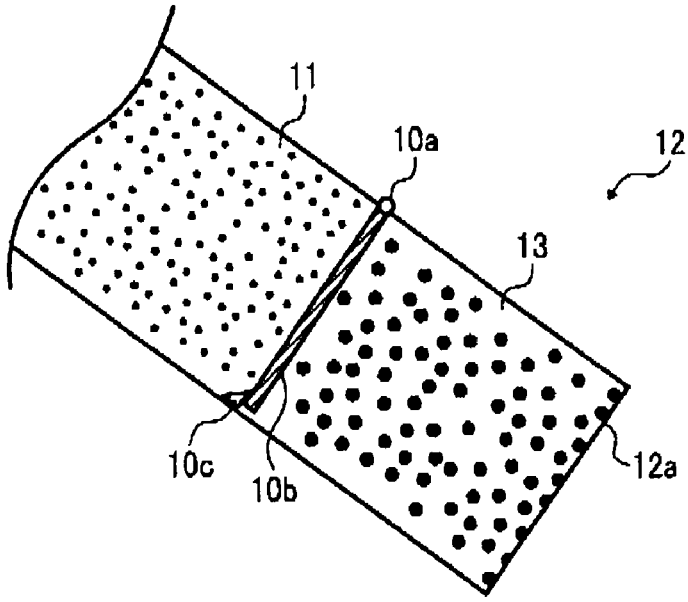
FIGS. 5A and 5B are schematic diagrams illustrating an example of a replenisher tube in different states, incorporated in the development device of FIGS. 4A and 4B.
Figure 5B:
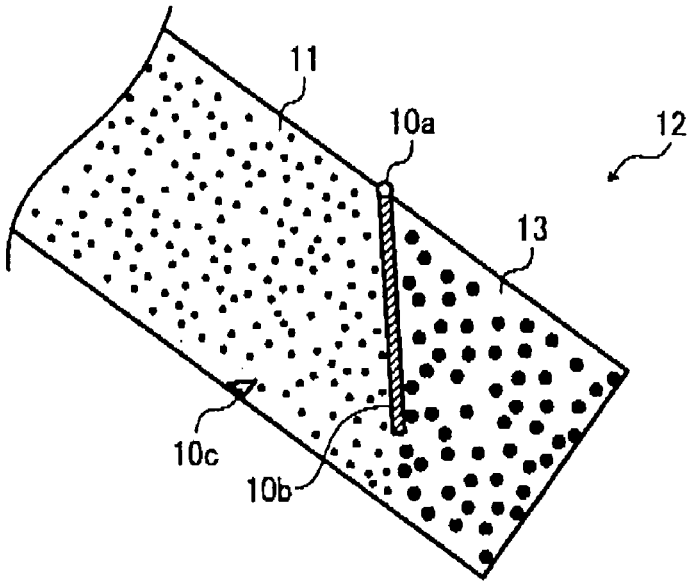

Referring now to FIGS. 5A and 5B, schematic diagrams illustrating an example of different states of the replenisher tube 12, which may be incorporated in the development device 9, are described.

As shown in FIGS. 5A and 5B, the replenisher tube 12 includes a backflow prevention valve 10 formed of a hinge 10*a*, a flap 10*b*, and a stopper 10*c*. The backflow prevention valve 10 is located internally to the replenisher tube 12 adjacent to the open port 12*a*. In the backflow prevention valve 10, the flap 10*b* is pivotable about the hinge 10*a* upward and downward according to a flow of air and/or particles inside the replenisher tube 12. The stopper 10*c* is located so as to restrict upward pivoting of the flap 10*b*. The flap 10*b* may prevent upward flow when in contact with the stopper 10*c*.

The backflow prevention valve 10 controls flow through the replenisher tube 12 so as to avoid an increase in toner concentration of the developer 13 in the first chamber 14*a*. Assume that the first chamber 14*a* contains a relatively small quantity of the developer 13. As long as the first screw conveyor 1 does not rotate to force the developer 13 or air into the replenisher tube 12, the backflow prevention valve 10 is open with the flap 10*b* hanging down from the hinge 10*a* under gravity. When the toner 11 is dispensed to the replenisher tube 12 in this state, the backflow prevention valve 10 allows the toner 11 to pass by either lifting or not lifting the flap 10*b*.

After a given amount of the toner 11 is dispensed, the first screw conveyor 1 rotates within the first chamber 14*a*, which now holds a relatively large quantity of the developer 13. This causes the developer 13 to flow into the replenisher tube 12 via the open port 12*a*. The incoming developer 13 reaches an area below the backflow prevention valve 10 to lift the flap 10*a* against the stopper 10*c* and settles thereon to support the flap 10*a* from below. The backflow prevention valve 10 remains closed as long as there is no downward force sufficient to displace the developer 13 retaining the flap 10*a* against the stopper 10*c*.

As the developer 13 becomes depleted of toner, the toner 11 is dispensed to the replenisher tube 12 from the toner bottle 31. When the amount of the toner 11 dispensed is relatively small, the backflow prevention valve 10 is in a closed state and the toner 11 is not supplied to the developer 13 (FIG. 5A). When the amount of the toner 11 dispensed exceeds a given threshold, the toner 11 removes the flap 10*b* downward by weight or gravitational potential energy. As a result, the backflow prevention valve 10 is opened and the toner 11 is supplied to the developer 13 (FIG. 5B). The threshold depends on various conditions, including the location of the replenisher tube 12 relative to the first chamber 14*a* and the upward force cause by the rotation of the first screw conveyor 1, which may be taken into account in designing the replenisher unit 19 with the backflow prevention valve 10.

Figure 6:
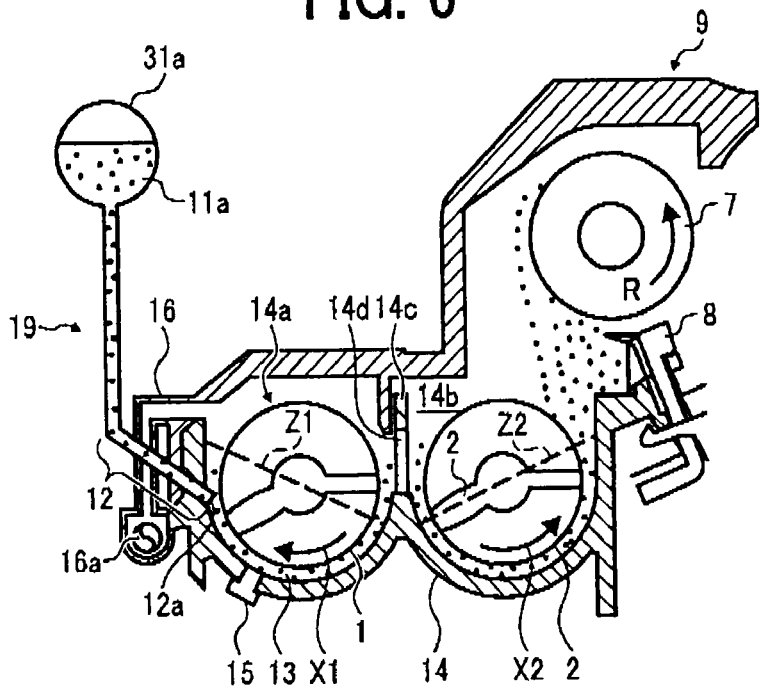
FIG. 6 is a side cross-sectional view schematically illustrating another embodiment of the development device of FIGS. 4A and 4B.

Referring now to FIG. 6, a side cross-sectional view schematically illustrating another embodiment of the development device 9 is described.

The embodiment described in FIG. 6 is configured in a manner similar to that illustrated in FIGS. 4A and 4B, except that the replenisher unit 19 communicates with a toner bottle 31*a* containing toner 11*a* to which a specified amount of carrier particles is added (commonly referred to as "pre-mix toner"), and the first chamber 14*a* has an overflow vent 16 connected to a trough having a screw conveyor 16*a* rotatably mounted therewithin. The overflow vent 16 extends downwardly from an opening disposed at an upper portion of the first chamber 14*a*.

In such a configuration, when the replenisher unit 19 supplies the toner 11*a* to the first chamber 14*a*, the developer 13 circulating in the first chamber 14*a* partially overflows into the overflow vent 16 via the opening. The overflow vent 16 directs the overflowing particles to the trough, in which the screw conveyor 16*a* rotates to transport the exiting particles to a waste bottle, not shown.

Figure 7:
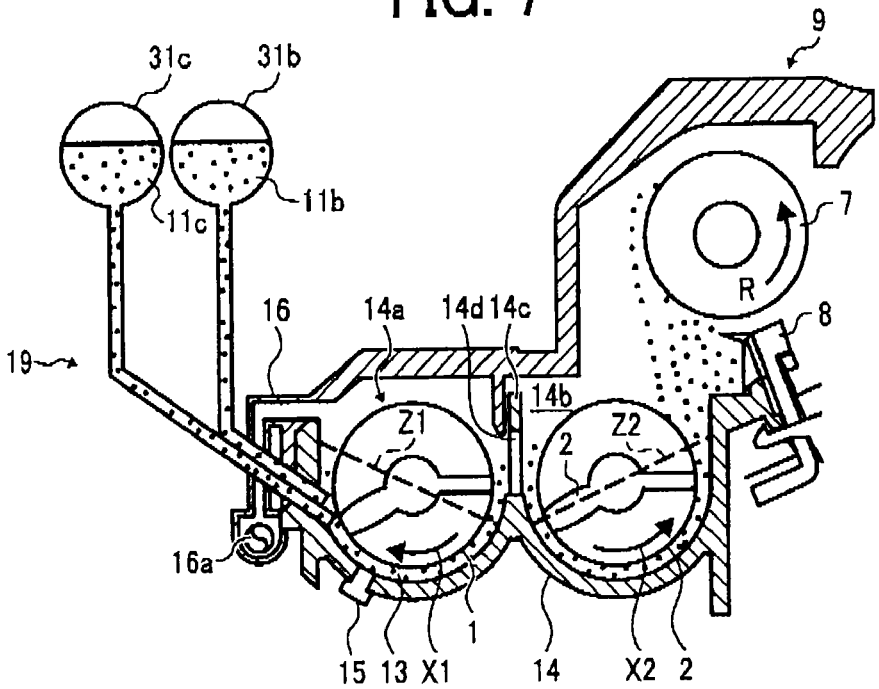
FIG. 7 is a side cross-sectional view schematically illustrating another embodiment of the development device of FIGS. 4A and 4B.

Referring to FIG. 7, a side cross-sectional view schematically illustrating another embodiment of the development device 9 is described.

The embodiment described in FIG. 7 is configured in a manner similar to that illustrated in FIG. 6, except that the replenisher unit 19 communicates with a toner bottle 31*b* containing toner 11*b* as well as with a carrier bottle 31*c* containing carrier 11*c*.

In such a configuration, the replenisher unit 19 supplies the carrier 11*c* from the carrier bottle 31*c* at a given time during operation, independent of the replenishment of the toner 11*b* from the toner bottle 31*b*. The supply of particles causes the developer 13 in the first chamber 14*a* to partially overflow into the overflow vent 16 to be transported to the waste bottle upon rotation of the screw conveyor 16*a*.

The embodiments depicted in FIGS. 6 and 7 may enhance developing performance of the development device 9. Each time the replenisher unit 19 supplies a given amount of particles, the developer 13 circulating in the first chamber 14*a*, which is likely to contain carrier particles suffering degradation through use, may be refreshed with new toner and/or carrier contained in the supplied material. This both increases useful life and ensures homogeneity of the developer 13 in the development device 9.

Figure 8A:
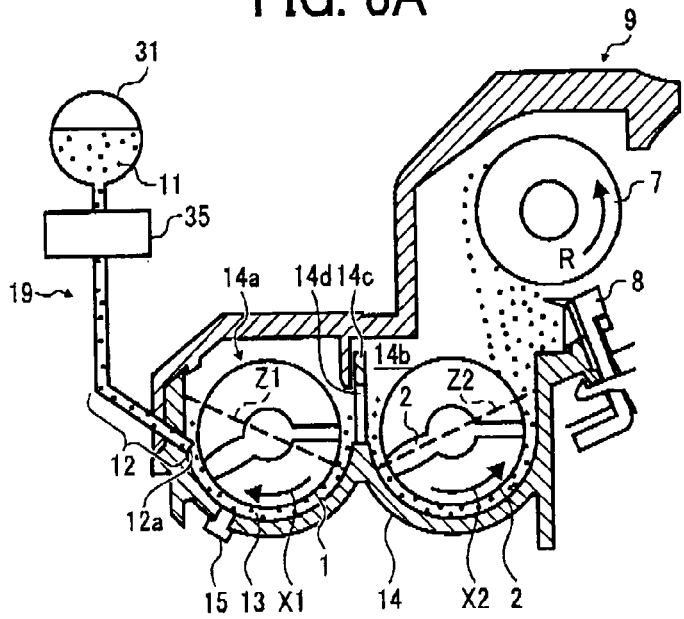
FIGS. 8A through 8C are schematic diagrams illustrating another embodiment of the development device of FIGS. 4A and 4B.
Figure 8B:
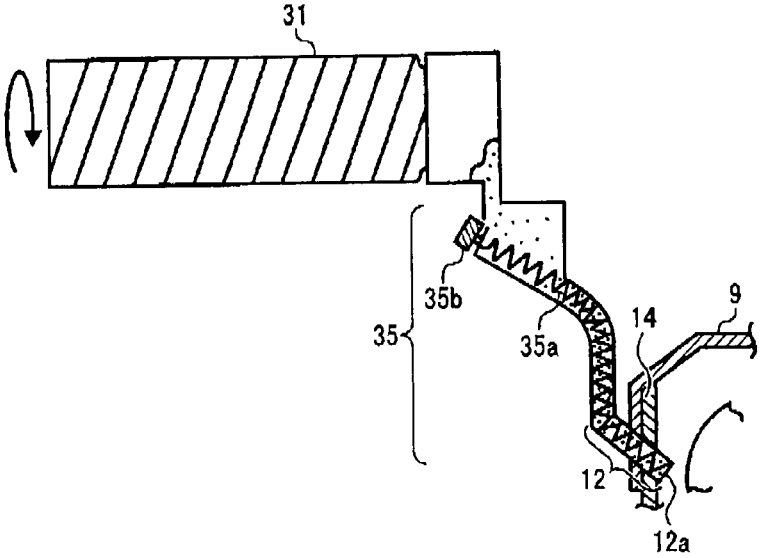
Figure 8C:
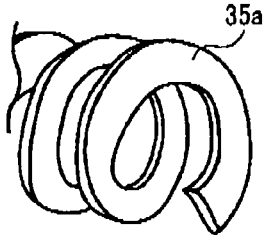

Referring now to FIGS. 8A through 8C, schematic diagrams illustrating another embodiment of the development device 9 are described. These drawings illustrate a general structure of the development device 9, and therefore geometric relations between components, especially between the replenisher unit 19 and the developer reservoir 14 in FIG. 8B, are not meant to be exact and are presented for illustrative purposes only.

The embodiment described in FIGS. 8A through 8C is configured in a manner similar to that illustrated in FIGS. 4A and 4B, except that the replenisher unit 19 includes a screw conveyor 35 disposed in the tubular portion thereof.

As shown in FIG. 8A through 8C, the screw conveyor 35 includes a helical impeller 35*a* and a gear 35*b*, mounted between the toner bottle 31 and the first chamber 14*a*. The helical impeller 35*a* is operably connected to the gear 35*b*, which engages a suitable drive member, not shown. The helical impeller 35*a* is configured as an elongated, flat flexible member formed of resin material such as polypropylene and helically coiled to fit inside the tubular portion of the replenisher unit 19. The helical impeller 35*a* extends from one end of the tubular portion of the replenisher unit 19, and preferably occupies the entire length of the replenisher tube 12.

In such a configuration, the screw conveyor 35 impels the toner 11 along the tubular portion of the replenisher unit 19 by rotating the helical impeller 35*a* via the gear 35*b*. The impelling force provided by the screw conveyor 35 reduces the need to rely on the gravitational force for conveying the toner 11 along the replenisher unit 19. Thus, using the screw conveyor 35 with a relatively large impelling force makes it possible to configure the developer device 9 with the replenisher tube 12 inserted into the first chamber 14*a* in a nearly horizontal direction rather than in an oblique, downward-slanting direction.

In addition, the screw conveyor 35 may be installed on the replenisher unit 35 with or without the backflow prevention valve 10. When installed with the backflow prevention valve 10, the screw conveyor 35 is arranged with the helical impeller 35*a* terminating at a point short of the open port 12*a*. By providing the backflow prevention valve 10 in the replenisher tube 12, backflow of the developer 13 may be reliably prevented. When installed without the backflow prevention valve 10, the screw conveyor 35 is arranged with the helical impeller 35*a* occupying the total length of the replenisher tube 12. As the developer 13 is less likely to flow into the occupied portion of the replenisher tube 12, backflow of the developer 13 may also be prevented in this configuration as well.

The embodiment depicted in FIGS. 8A through 8C enhances mixing performance of the development device 9 because it employs mechanical force to impel the supply of toner to inject the toner into the developer rather than by relying solely on gravity. This provides desirable mixing of developer material in electrophotographic development, enhancing density uniformity of developed images and reducing defects due to insufficiently charged toner particles.

Figure 9A:
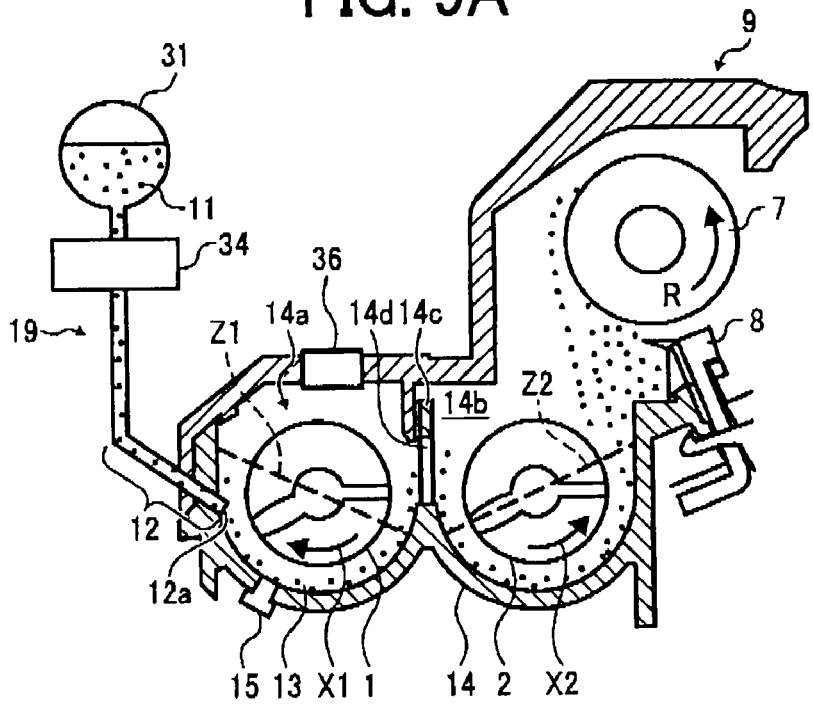
FIGS. 9A and 9B are cross-sectional side and top views schematically illustrating still another example of a development device, incorporated in the image forming unit of FIG. 3.
Figure 9B:
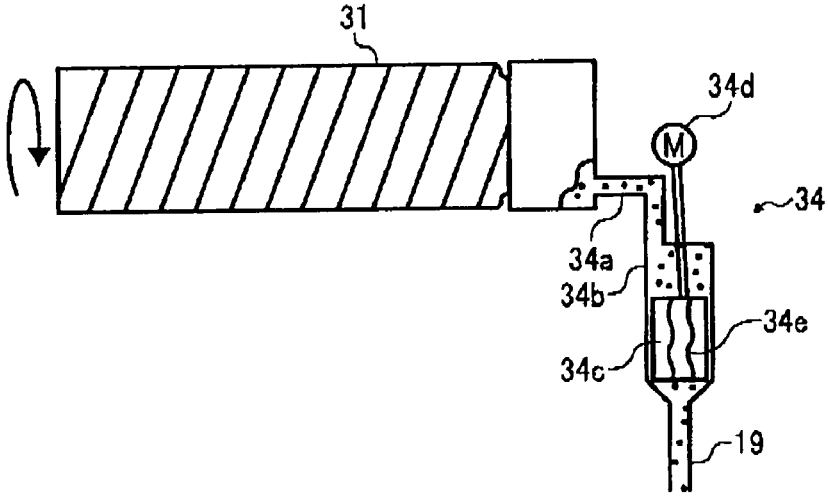

Referring now to FIGS. 9A and 9B, cross-sectional side and top views schematically illustrating still another example of a development device 9, which may be incorporated in the image forming unit of FIG. 3, are described.

The embodiment described in FIGS. 9A and 9B is configured in a manner similar to that illustrated in FIGS. 4A and 4B, except that the replenisher unit 19 is provided with a pump 34, the first chamber 14*a* is provided with an outlet filter 36, and the first screw conveyor 1 has a flight smaller than that in FIGS. 4A and 4B.

As shown in FIGS. 9A and 9B, the pump 34 is mounted between the toner bottle 31 and the first chamber 14*a*. The pump 34 is configured as a progressive cavity pump or eccentric screw pump, including a supply pipe 34*a*, a casing 35*b*, a stator 34*c*, a motor 34*d*, and a rotor 34*e*, located at an upper portion of the replenisher unit 19 and connected to the toner bottle 31 immediately thereabove. In the pump 34, the supply pipe 34*a* communicates with the toner bottle 31, and serves to conduct the toner 11 to the casing 34*b*. The casing 34*b* serves to hold the toner 11 for forwarding to the tubular portion of the replenisher unit 19. The stator 34*c* is formed of plastic such as propylene rubber or silicon rubber, and has a bore extending therethrough, not shown. The motor 34*d* is connected to the rotor 34*e* to impart a driving force thereto. The rotor 34*e* is inserted into the bore of the stator 34*c* so as to operate in cooperation therewith. The outlet filter 36 is located at an upper surface of the first chamber 14*a* and has a lower side facing the first screw conveyor 1.

In such a configuration, the toner 11 dispensed from the toner bottle 31 travels to the casing 34*b* via the supply pipe 34*a*. The motor 34*d* rotates the rotor 34*e* inside the stator 34*c* in a reciprocating motion, in which air drawn into the bore of the stator 34*c* is compressed to a given high pressure. The rotation of the rotor 34*e* pneumatically transports the toner 11 to the tubular portion of the replenisher unit 19 and to the first chamber 14*a*. The air from the replenisher unit 19 then exits the first chamber 14*a* via the outlet filter 36 without blowing or scattering the developer 13 out of the developer reservoir 14.

Further, the first screw conveyor 1 has a flight appropriately sized so as to allow the replenisher tube 12 to penetrate into the first chamber 14*a* as long as possible, so that the toner 11 can be more effectively introduced into the developer 13. For example, the replenisher tube 12 may penetrate 2 millimeters into the first chamber 14*a* with a tube cross-section being a square 10 millimeters on a side or a circle 10 millimeters in diameter. Again, as above, the replenisher tube 12 may be provided with the backflow prevention valve 10 for preventing backflow of the developer 13.

The embodiment depicted in FIGS. 9A and 9B enhances mixing performance of the development device 9 because, rather than relying solely on gravity, it employs pneumatic force to impel the supply of toner to inject the toner into the developer. This provides desirable mixing of developer material in electrophotographic development, enhancing density uniformity of developed images and reducing defects due to insufficiently charged toner particles.

Although the embodiments illustrated above use the first and second screw conveyors 1 and 2 with the first and second chambers 14*a* and 14*b* associated therewith, it is contemplated that the developer device 9 be provided with one or more than two screw conveyors for conveying the developer 13 within the developer reservoir 14. In each case, the replenisher tube 12 is connected to a chamber and/or a location immediately downstream of the area where the developer 13 starts recirculating in the developer reservoir 14 after development process.

Tests were conducted to assess mixing performance of various development devices produced in accordance with this patent specification compared to a conventional development device. Each development device was mounted in an image forming unit of a particular color configured in a manner similar to that described in FIG. 3. Printing was performed using an image forming apparatus configured in a manner similar to that described in FIG. 2. For testing, four development devices were prepared as follows:

Example 1

A development device was configured as illustrated in FIGS. 4A and 4B, wherein the backflow prevention valve 10 is not provided.

Example 2

A development device was configured as illustrated in FIGS. 4A and 4B, wherein the backflow prevention valve 10 is provided.

Example 3

A development device was configured as illustrated in FIGS. 9A and 9B, wherein the backflow prevention valve 10 is not provided.

Comparative Example

A conventional development device was prepared. The conventional development device included a guide member forming a vertical path to introduce toner downwardly from an upper surface of a developer reservoir, in which a screw conveyor rotates toward an outlet of the vertical path.

Test 1 (Uniformity of Toner Concentration)

Toner concentration uniformity in developer material mixed in the developer reservoir was assessed. A total of ten consecutive operations were performed to print solid-colored pages on A4 size paper. After printing, the process cartridge was removed to inspect the development device. Toner concentrations were measured at six locations within the first and second chambers, including a midpoint and another two points along the length of the first screw conveyor separated from each other by 100 mm, and a midpoint and another two points along the length of the second screw conveyor separated from each other by 100 mm. Measured values were compared to evaluate uniformity thereof.

Test 2 (Uniformity of Density)

Uniformity of density across a printed page was assessed. A total of fifty consecutive operations were performed to print solid-colored pages on A4 size paper using the development device. Printed pages were inspected to determine whether there were non-uniform areas present on one side of the page, corresponding to one extremity of the second chamber at which developer was supplied from the first chamber.

Test 3 (Prevention of Toner Contamination)

Efficacy in preventing toner contamination was assessed. After Test 2, the interior of the image forming apparatus was inspected to visually detect the degree of contamination by toner particles emanating from the developer reservoir.

Test 4 (Density Stability)

Density stability between consecutively printed pages was assessed. Each of the test pages produced in Test 2 was divided into nine rectangular regions in a three-by-three grid. Image density was measured at a specific point within each of the nine rectangles per page. Each set of measured values for corresponding locations of different pages was evaluated for consistency.

The results of these tests are shown in Table 1 below.

TABLE 1

Evaluation results for Tests 1 through 4

| | Concentration uniformity | Density uniformity | Prevention of toner contamination | Density stability |
|---|---|---|---|---|
| Example 1 | Good | Good | Good | Fair |
| Example 2 | Good | Good | Good | Good |
| Example 3 | Good | Good | Good | Good |
| Comp. Ex. | Fair | Fair | Fair | Fair |

Note:
In Table 1, "Fair" indicates that the properties were acceptable while suffering some minor defects, and "Good" indicates that the properties were better than those rated fair.

As shown in Table 1, all three development devices Examples 1 through 3 configured according to this patent specification exhibited improved properties compared to the conventional development device in terms of concentration uniformity, density uniformity, and prevention of toner scattering. Improved density stability was obtained in the development devices Examples 2 and 3, whereas Example 1, not provided with either the backflow prevention valve 10 nor the pump 34, showed moderate density stability.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop an electrostatic latent image formed on a photoconductive surface with a developer formed of toner and carrier, the device comprising:

a developer roller configured to supply toner particles to the electrostatic latent image;

a developer reservoir configured to hold the developer therewithin for application to the developer roller;

a rotatable conveyor configured to rotate within the developer reservoir to convey the developer toward the developer roller; and a replenisher unit, having a tubular member terminating at a port opening in the developer reservoir, configured to direct particulate material through the tubular member into the developer reservoir via the port, the particulate material being toner particles, carrier particles, or a mixture of toner particles and a given amount of carrier particles, the port being submerged in the developer within the developer reservoir as the rotatable conveyor rotates, wherein the replenisher unit directs the particulate material through the tubular member obliquely downward into the developer reservoir with the port facing toward the outer periphery of the rotatable conveyor such that the particulate material is traveling downward at a point of entry into the developer reservoir from the replenisher unit.

2. The development device according to claim 1, wherein the rotatable conveyor rotates to move an outer periphery thereof vertically upward in front of the port.

3. The development device according to claim 1, wherein the replenisher unit impels the particulate material through the tubular member into the developer reservoir.

4. The development device according to claim 1, wherein the tubular member includes a check valve to prevent the developer from flowing backward up into the tubular member from the developer reservoir.

5. The development device according to claim 4, wherein the rotation of the rotatable conveyor induces a flow of particles toward the port to close the check valve in the tubular member.

6. The development device according to claim 4, further comprising a pump, operably associated with the replenisher unit, configured to provide compressed air to the tubular member to pneumatically move the particulate material downward to the developer reservoir.

7. The development device according to claim 6, further comprising an air outlet, formed on a wall of the developer reservoir, configured to release the compressed air from the development device.

8. An integrated process cartridge removably installable in an image forming apparatus, the process cartridge comprising:

a photoconductor configured to form an electrostatic latent image thereon; and a development device configured to develop the electrostatic latent image with a developer formed of toner and carrier, the developer device including:

a developer roller configured to supply toner particles to the electrostatic latent image;

a developer reservoir configured to hold the developer therewithin for application to the developer roller;

a rotatable conveyor configured to rotate within the developer reservoir to convey the developer toward the developer roller; and a replenisher unit, having a tubular member terminating at a port opening in the developer reservoir, configured to direct particulate material through the tubular member into the developer reservoir via the port, the particulate material being toner particles, carrier particles, and a mixture of toner particles and a given amount of carrier particles, the port being submerged in the developer within the developer reservoir as the rotatable conveyor rotates, wherein the replenisher unit directs the particulate material through the tubular member obliquely downward into the developer reservoir with the port facing toward the outer periphery of the rotatable conveyor such that the particulate material is traveling downward at a point of entry into the developer reservoir from the replenisher unit.

9. The process cartridge according to claim 8, further comprising a charging device configured to charge the photoconductor.

10. The process cartridge according to claim 8, further comprising a cleaning device configured to remove residual toner particles remaining on the photoconductor after the developed image is transferred to a receiving member.

11. An electrophotographic image forming apparatus, comprising:

a photoconductor configured to form an electrostatic latent image thereon; and a development device configured to develop the electrostatic latent image with a developer material formed of toner and carrier, the developer device including:

a developer roller configured to supply toner particles to the electrostatic latent image;

a developer reservoir configured to hold the developer therewithin for application to the developer roller;

a rotatable conveyor configured to rotate within the developer reservoir to convey the developer toward the developer roller; and a replenisher unit, having a tubular member terminating at a port opening in the developer reservoir, configured to direct particulate material through the tubular member into the developer reservoir via the port, the particulate material being toner particles, carrier particles, or a mixture of toner particles and a given amount of carrier particles, the port being submerged in the developer within the developer reservoir as the rotatable conveyor rotates, wherein the replenisher unit directs the particulate material through the tubular member obliquely downward into the developer reservoir with the port facing toward the outer periphery of the rotatable conveyor such that the particulate material is traveling downward at a point of entry into the developer reservoir from the replenisher unit.

12. The image forming apparatus according to claim 11, wherein the photoconductor and the development device are integrated into a removably installable process cartridge.

13. The image forming apparatus according to claim 12, wherein the process cartridge includes a charging device configured to charge the photoconductor.

14. The image forming apparatus according to claim 12, wherein the process cartridge includes a cleaning device configured to remove residual toner particles remaining on the photoconductor after the developed image is transferred to a receiving member.

* * * * *